US010323371B2

(12) United States Patent
Bigata et al.

(10) Patent No.: US 10,323,371 B2
(45) Date of Patent: Jun. 18, 2019

(54) ABSORPTION AND MARKING OF A POTENTIALLY DANGEROUS SUBSTANCE

(71) Applicant: Hg3 S.a.r.l., Luxembourg (LU)

(72) Inventors: Eric Bigata, Mios (FR); Joel Blomet, Valmondois (FR)

(73) Assignee: HG3 S.A.R.L., Luxembourg (LU)

( * ) Notice: Subject to any disclaimer, the term of this patent is extended or adjusted under 35 U.S.C. 154(b) by 0 days.

(21) Appl. No.: 15/539,071

(22) PCT Filed: Dec. 14, 2015

(86) PCT No.: PCT/EP2015/079625
§ 371 (c)(1),
(2) Date: Dec. 5, 2017

(87) PCT Pub. No.: WO2016/102226
PCT Pub. Date: Jun. 30, 2016

(65) Prior Publication Data

US 2018/0127934 A1 May 10, 2018

(30) Foreign Application Priority Data

Dec. 23, 2014 (FR) ..... 14 63265

(51) Int. Cl.
*E01H 1/00* (2006.01)
*E01C 19/20* (2006.01)
(Continued)

(52) U.S. Cl.
CPC ..... *E01H 1/001* (2013.01); *E01C 19/2005* (2013.01); *E01F 9/654* (2016.02); *E01F 9/692* (2016.02)

(58) Field of Classification Search
CPC ..... E01H 1/001; E01C 19/2005; E01F 9/654; E01F 9/692
(Continued)

(56) References Cited

U.S. PATENT DOCUMENTS 6,968,946 B2 * 11/2005 Shuert ..... B65D 19/0028 206/386
7,523,717 B2 * 4/2009 Nicholes ..... A01K 5/0225 119/51.01
(Continued)

FOREIGN PATENT DOCUMENTS

CH 643 314 A5 5/1984
GB 2 124 280 A 2/1984

OTHER PUBLICATIONS

International Search Report dated May 13, 2016, in corresponding PCT application.

*Primary Examiner* — Benjamin R Shaw
(74) *Attorney, Agent, or Firm* — Young & Thompson

(57) ABSTRACT

Disclosed is a device for absorbing and marking a potentially dangerous substance on the ground, the device including: an elongate hollow body, the inner walls of which define a storage space in which a powder is stored which is capable of absorbing the substance when the powder comes into contact with the substance, the storage space leading into an opening for pouring the powder onto the substance in order to neutralize the substance, a base on which the lower end of the body is directly or indirectly mounted, the base projecting laterally relative to the body so as to form a marker in order to position the device on the ground in a stable manner and to mark the presence of the absorbed substance on the ground.

19 Claims, 6 Drawing Sheets

(51) Int. Cl.
*E01F 9/654* (2016.01)
*E01F 9/692* (2016.01)

(58) Field of Classification Search
USPC ..... 222/185.1, 192
See application file for complete search history.

(56) References Cited

U.S. PATENT DOCUMENTS

| | | | | |
|---|---|---|---|---|
| 7,823,757 | B1 * | 11/2010 | Vinson | E01H 1/001 222/162 |
| 2004/0107619 | A1 * | 6/2004 | Perelli | G09F 15/0025 40/610 |
| 2004/0231214 | A1 * | 11/2004 | Bober | A47L 13/00 40/610 |
| 2005/0056202 | A1 * | 3/2005 | Bober | A47L 13/00 116/200 |
| 2005/0066562 | A1 * | 3/2005 | Bober | A47L 13/00 40/610 |
| 2010/0319607 | A1 * | 12/2010 | Julnes | G09F 1/06 116/63 C |
| 2011/0192866 | A1 * | 8/2011 | Shaw | B65G 47/19 222/185.1 |
| 2014/0071681 | A1 * | 3/2014 | Ghafoori | F21V 33/0076 362/249.14 |

* cited by examiner

ABSORPTION AND MARKING OF A POTENTIALLY DANGEROUS SUBSTANCE

TECHNICAL FIELD

The present invention relates to the field of risk prevention, and notably the prevention of health risks.

The subject matter of the present invention thus relates to a device allowing a potentially hazardous product on a floor to be absorbed, possibly neutralized, and signaled.

What is meant here within the context of the present invention by a potentially hazardous product is, throughout the present description, a product which more generally takes the form of a liquid, a paste or a powder, and which is liable to represent a risk to an individual; this may for example be a health risk if the product is potentially toxic to an individual or if the product is corrosive or irritant, notably when for example the product comes into contact with the skin or the eyes, or even when the product is inhaled or ingested. It may also relate to a physical or bodily risk when, for example, the product in question may cause the individual to slip.

These may, by way of nonlimiting examples, be chemical or organic products or even food or biological products such as, for example, paint (acrylic or glycerophthalic), wood stain, oil, chemical liquids for example based on solvents, strong acids, oxidants, strong bases, etching and pickling agents, cleaning liquids or powders, detergents, solvents, fertilizers, insecticides, fungicides, or weed killers, etc.

PRIOR ART

In everyday life or at work, the potentially hazardous products such as those defined hereinabove may present problems of pollution and/or of safety at various levels.

For example, a road accident involving a truck carrying toxic or hazardous raw materials may cause environmental pollution and spillage mess on the road.

In an industrial environment or in a laboratory, an error in the handling of a can containing a toxic or hazardous raw material may cause injury to the individual or damage to the installations.

By enabling potentially hazardous products to be absorbed, possibly neutralized, and signaled, the present invention finds numerous advantageous applications notably in the field of mass distribution or else in the field of industry or in laboratory settings.

By way of example of applications of the invention, mention may be made of the absorption, possibly neutralization, and signaling of a potentially hazardous product on the floor in a department of a DIY or gardening store; in this application, the invention is particularly advantageous at preventing the customers and staff from being exposed to both bodily and health risks, for example when the product on the floor is a paint, an acid, or a solvent-based chemical product. Specifically, it is unfortunately commonplace for reactive, corrosive and/or irritant products such as hydrochloric acid (used for unblocking sinks), present on the shelves of a DIY or gardening store, to be accidentally spilled onto the floor and cause accidents, these accidents being all the more troublesome since they usually affect customers.

Other advantageous applications may also be envisioned within the context of the invention, such as, for example, the absorption, possibly the neutralization, and the signaling of a potentially hazardous product on the floor in an industrial environment, and notably in a chemical industry in which the employees regularly handle chemical products which are generally corrosive and irritant, harmful to a greater or lesser extent, such as, for example, strong acids or strong bases. In such an environment, it is commonplace for these products to drop onto the floor and for staff members to come accidentally into contact with these products.

Swift control of these products spilled onto the floor is of key importance in a quite many situations.

Let us consider more particularly the problem of preventing risks in mass distribution.

In stores, and notably in stores specializing in DIY and/or in gardening, a staff member is generally appointed to monitor correct application within the store or within a department of all the rules and regulations regarding risk prevention, these risks being those to which both the staff and the customers of the store are exposed.

This staff member is therefore appointed as health and safety officer. He or she may for example be a head of department or the store manager.

Conventionally, this prevention notably entails markings throughout the store in order to:

- prevent risks of slipping: by using a warning cone,
- prevent risks associated with potentially toxic products: by using appropriate information panels or floor markings.

In general, it is important for the information intended for the customers and for the staff to be clear, accurate, and understood by all.

The marking, in the form of information panels, warning cones, pictograms, needs to be in place in all the identified risk zones.

It will be readily understandable that the customer or staff member who has suffered an accident within the confines of a store often seeks to invoke the legal liability of the store, particularly if the store has not complied with all the safety measures: claims for homicide or unintentional injuries, with the aggravating circumstance of a failure to meet safety obligations or observe safe practices, or even for endangering others are very often brought before the courts.

This is very bad both for the financial performance of the store which has notably to absorb the financial consequences of the accident and for the brand image and good name of the store.

In order to ensure the safety of the customers and staff in the stores, caution floor signs BP such as those illustrated in FIG. 1 are known; these floor signs are compulsory in each store and have to be set in place immediately following a spillage of a potentially hazardous product.

Aside from these signaling elements, there are solutions put in place for absorbing a product on the floor.

One first solution for absorbing the product on the floor is to use wipes, a shovel or a brush, or even a wet cloth.

It will be appreciated here that such a solution that only makes it possible for the product to be absorbed is to be avoided when the product is a chemical product.

Another solution for absorbing the product is to spread sawdust onto the product in question.

The applicant submits that the use of sawdust is the solution most widely used in DIY and/or gardening stores.

However, this sawdust is usually kept in bags weighing several tens of kilograms; thus it is difficult to handle such bags in order to tip the sawdust out onto the product.

Given these complex handling operations, it is difficult to measure out the quantity of sawdust poured onto the product. There is, therefore, a great deal of waste.

The applicant additionally notes that the size of these bags makes these bags difficult to store near the store departments; it is therefore difficult to respond immediately once a spillage of product onto the floor has been identified.

Moreover, mixing chemical components with wood agglomerates is not recommended; thus, the sawdust does not fully absorb the spillage of paint on the floor. This sawdust effectively forms agglomerates which are still liquid on the inside. If they are not collected up immediately, the risk of customers slipping remains relatively high.

It has also been found that pulverizing sawdust implies inhaling substances that are hazardous or even carcinogenic.

Accordingly, the health authorities recommend that the use of sawdust be avoided.

SUMMARY OF THE PRESENT INVENTION

The present invention seeks to improve the situation described hereinabove.

The present invention seeks to overcome the various disadvantages mentioned hereinabove by proposing a solution that is simple to use and effective making it possible to absorb and signal the presence of a potentially hazardous product on the floor.

To this end, a first aspect of the present invention relates to a device for absorbing and signaling a potentially hazardous product on a floor.

Advantageously, the device according to the present invention comprises a longilinear hollow body the interior walls of which define a storage volume.

Stored inside this storage volume is a powder able to absorb the potentially hazardous product when the powder comes into contact with said product.

This is also referred to as an absorbent powder.

This powder may also be able to neutralize the potentially hazardous product.

In this case, it is referred to as an absorbing and neutralizing powder.

It will be appreciated here that, in that case, the device is a device for absorbing, neutralizing and signaling a potentially hazardous product on the floor.

Advantageously, the storage volume opens onto an opening for pouring the powder out under gravity onto the product.

This powder, by covering the product, absorbs and possibly neutralizes same.

Advantageously, the device according to the present invention additionally comprises a standing support on which the end of the lower portion of the body is mounted directly or indirectly.

According to the present invention, the standing support projects out laterally with respect to the body to form a warning cone so that the device can be stably stood on the floor.

By placing the standing support on the floor, the presence of the absorbed and possibly neutralized product on the floor is signaled.

A person skilled in the art will appreciate here that this standing support may consist of any type of means allowing said device to be stabilized on the floor.

Thus, as much through its structure as through its configuration, the device according to the invention takes the form of a prevention tool which is simple to use.

All the individual in charge of safety needs to do is pour the powder through the opening onto the potentially hazardous product, and then place the standing support over the product absorbed and neutralized by the powder or near same in order to signal to third parties that there is a potential risk present.

The present invention replaces the floor signs and the use of sawdust by proposing a single tool capable simultaneously of:

- storing a powder able to absorb and possibly neutralize a potentially hazardous product, and
- signaling the presence of said product on the floor.

The subject of the present invention thus offers a dual function of both storing a pulverulent product (which absorbs and neutralizes the hazardous product) and of signaling said product on the floor.

In one embodiment, the opening is closed by a removable cap.

In another embodiment, the opening is closed by a detachable seal.

In one embodiment just as in the other, all the individual in charge of safety needs to do is remove the cap or detach the seal in order to release the powder so that the powder is poured out onto the product by gravity.

Preferably, said opening is equipped with a pouring spout to make it easier for the powder to be poured out under gravity onto the product.

Such a spout is advantageous for correctly measuring out the powder poured out onto the product.

Preferably, the opening formed in the hollow body opens onto the lower face of the standing support, said lower face facing the floor when the standing support is resting on said floor.

In one particularly advantageous embodiment, the standing support has:

- a wall extending substantially at right angles to the longitudinal axis of the body, and
- peripheral rims extending substantially at right angles to the wall in order to bear against the floor.

Thus, in this embodiment, the peripheral rims form, with the wall, a closed volume when the standing support is resting on the floor through the rims.

It is thus possible to cover the potentially hazardous product by placing the standing support over the product.

If the surface area of the potentially hazardous product on the floor is smaller than the surface area of the standing support, correct positioning of the standing support on the area covered by the product makes it possible to prevent any direct contact of an individual with the potentially hazardous product.

When the surface area of the product on the floor is greater than the surface area of the standing support, provision is made for the device to comprise on the periphery of the standing support a housing in which there is housed a protective film able to be unwound to at least partially cover the product on the floor.

Preferably, the protective film is extensible.

Alternatively, the standing support comprises fold-out panels, for example made of cardboard, housed under the standing support. These panels are then able to be folded out in order to at least partially cover the product on the floor when, for example, the surface area of product on the floor is greater than the surface area of the standing support.

Advantageously, the device according to the present invention comprises a grip, such as, for example, a grab handle, which are formed on the body and which make the device easier to grasp notably when pouring the powder out under gravity onto the product.

Advantageously, the device according to the present invention further comprises an anchor, such as, for example, a hook, which are formed on the body to attach a link so that said device can be linked with at least one other absorption and signaling device so as to delimit on the floor a zone containing a potentially hazardous product.

In one advantageous embodiment, the body and the standing support are structurally independent of one another. In other words, these two elements constitute two distinct components separate from one another. In this embodiment, said body and said standing support each comprise an attachment able to collaborate with one another so as to securely assemble said body and said standing support with one another. This assembly can be done for example by interlocking the body into said standing support.

It is thus easy to store the device in order to minimize its bulk because the body and the standing support are two separate components which interlock one into the other using the attachment described hereinabove.

Correspondingly, the subject matter of the present invention in a second aspect relates to the use of an absorption and signaling device such as that described hereinabove to absorb and signal the presence on a floor of a potentially hazardous product.

Thus, through its various functional and structural aspects described hereinabove, the subject of the present invention constitutes a tool that is practical and easy to use and overcomes all the disadvantages hitherto encountered in matters of safety and prevention, notably in DIY or gardening stores, for absorbing, neutralizing and signaling the presence of a hazardous product on the floor.

BRIEF DESCRIPTION OF THE DRAWINGS

Further features and advantages of the present invention will become apparent from the description hereinbelow, with reference to the appended FIGS. 2 to 6, which illustrate an entirely nonlimiting embodiment and in which.

DETAILED DESCRIPTION OF THE INVENTION

Figure 1:
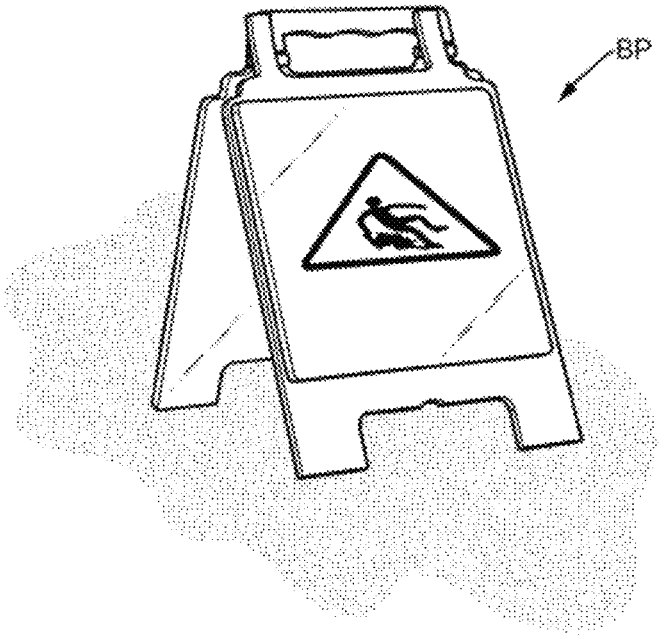
FIG. 1 (Prior Art)
FIG. 1 illustrates a prior art caution floor sign.

A device for absorbing, neutralizing and signaling a potentially hazardous product according to one exemplary embodiment of the present invention will now be described in what follows with reference jointly to FIGS. 2 to 6.

Remember that one of the objects of the present invention is to provide a practical tool that allows a potentially hazardous product to be simultaneously absorbed, neutralized and signaled.

The example described here relates mainly to an application in a DIY store.

It will be appreciated here that this is one example of one application from among many and that quite obviously the present invention can find other applications in other fields such as the prevention of risks, notably chemical risks, in an industrial environment or in a public place, such as, for example, in a railway station or underground station.

In the example described here, we consider the situation in which a pot of paint has fallen by accident into an aisle of a DIY store.

A paint P spilled on the floor S of the aisle of the store constitutes a risk both to the customers and to the staff of the store.

Specifically, it is possible to slip if walking on the paint P that is spilled on the floor S. In this case, it is essentially a bodily risk, even though ingestion of a paint may also represent a health risk.

The paint P therefore takes the form of a potentially hazardous product within the meaning of the present invention.

The person responsible for safety, for example in this instance the head of department, is therefore immediately alerted.

As recalled hereinabove, the objective for the head of department is first of all to absorb the paint P on the floor S and then to signal to third parties the presence of this paint P on the floor S.

The purpose of the absorption phase is to avoid a bodily accident if, for example, a customer or a staff member steps on the paint P on the floor and slips.

Absorption here consists in bringing the (liquid) paint into solid or granular form.

Conventionally, use is made of sawdust, which is not effective and is not very practical for the reasons mentioned hereinabove.

Here, absorption of this paint P using a powder 20 of the "POLYCAPTOR®" type is preferably contemplated.

Such a powder 20 is intended to combat any type of accidental spreading of the liquid product. On contact with a potentially hazardous product such as paint, the composition of this powder 20 makes it possible to absorb any type of product using a minimum quantity and at a cost that is lower than that of the absorbent powders currently marketed.

Moreover, the composition of this powder 20 is not hazardous (it is non-toxic, non-irritant, non-allergenic, and not eco toxic), unlike certain products currently marketed.

This powder of the "POLYCAPTOR®" type is therefore particularly suited to the use we wish to make of it in our exemplary application.

Quite obviously, a person skilled in the art will understand here that the use of other types of absorbent powder may be envisioned in the context of the present invention.

It is also possible by way of example to envision another situation in which the content of a bottle of hydrochloric acid has been spilled on the floor.

Such bottles are generally sold in DIY stores, notably for unblocking sinks.

It will be appreciated here that hydrochloric acid here constitutes a potentially hazardous product P within the meaning of the present invention.

Specifically, there is a health risk which could arise if, for example, the acid P were to come into contact with a customer's skin.

It is also possible to imagine an accidental inhalation or ingestion of this acid P.

In this specific instance, the head of department therefore needs to absorb and then neutralize the potential harmful and toxic chemical effects of the acid P on the floor S.

What is meant here by neutralize is limit or even eliminate all the potentially hazardous effects or reactions of the product. For example, in the case of an acid, it involves bringing the pH up to a value of between 5 and 10, or even bringing the pH value up to 7.

Here, in order to absorb and neutralize the acid P on the floor, the use of a powder 20 of the "TRIVOREX®" type is therefore preferably contemplated.

Quite obviously, a person skilled in the art will understand here that the use of other types of absorbent and neutralizing powder may be envisioned within the context of the present invention.

Thus, in order to spread this powder 20 onto the product P (paint or acid) to absorb and possibly neutralize this product, a device 100 is provided in the context of the present invention.

Figure 2:
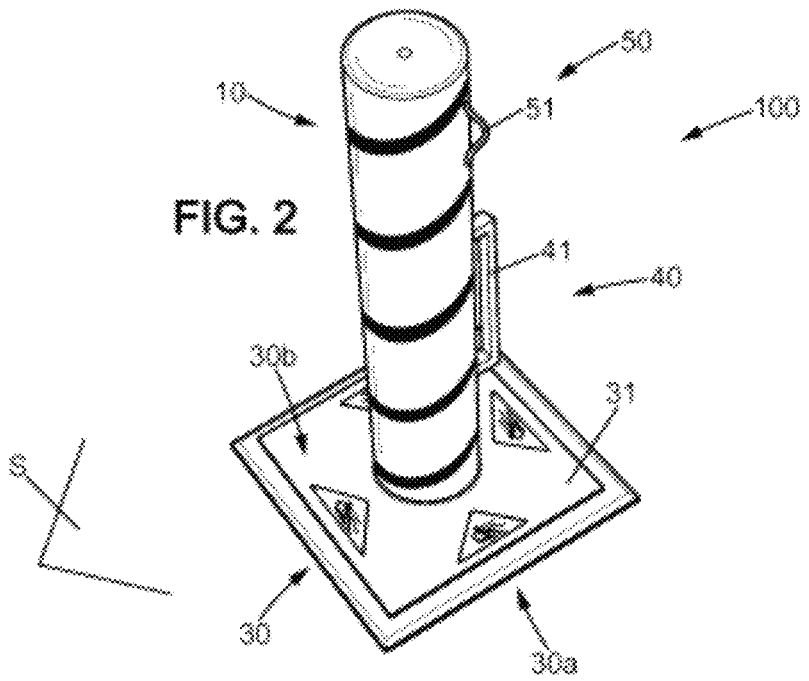
FIG. 2 schematically depicts a perspective view of a device for absorbing, neutralizing and signaling a potentially hazardous product according to one exemplary embodiment of the present invention.
Figure 4:
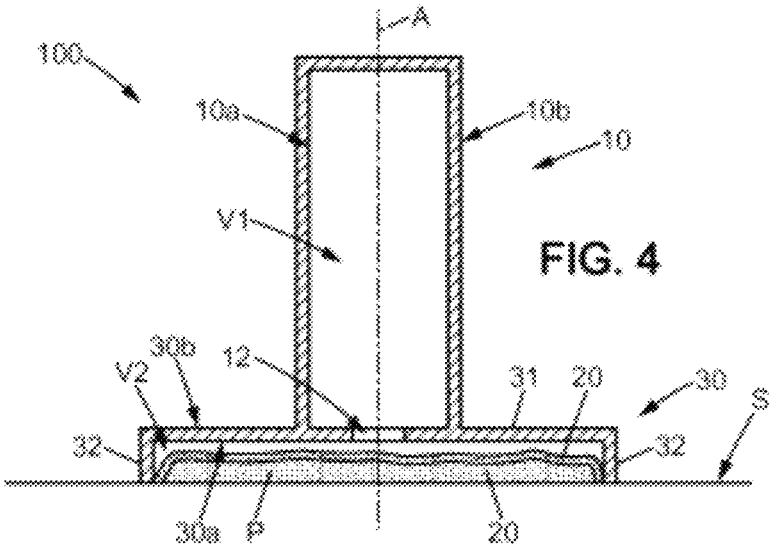
FIG. 4 schematically depicts a cross section of an absorption, neutralizing and signaling device according to FIG. 2.

As illustrated in FIGS. 2 and 4, the device 100 according to the present invention comprises a longilinear hollow body 10 of cylindrical shape.

In this example, the interior walls 10*a* of the cylinder define a storage volume V1 enabling storage of the powder 20.

Provision may be made for this cylinder to be made of cardboard and for the interior walls 10*a* of the cylinder to be covered with a protective film to isolate the powder from the rest.

Provision may also be made for this film to be fire retardant.

In the context of a use with "POLYCAPTOR®" or "TRIVOREX®", such a film is not necessary.

Figure 3:
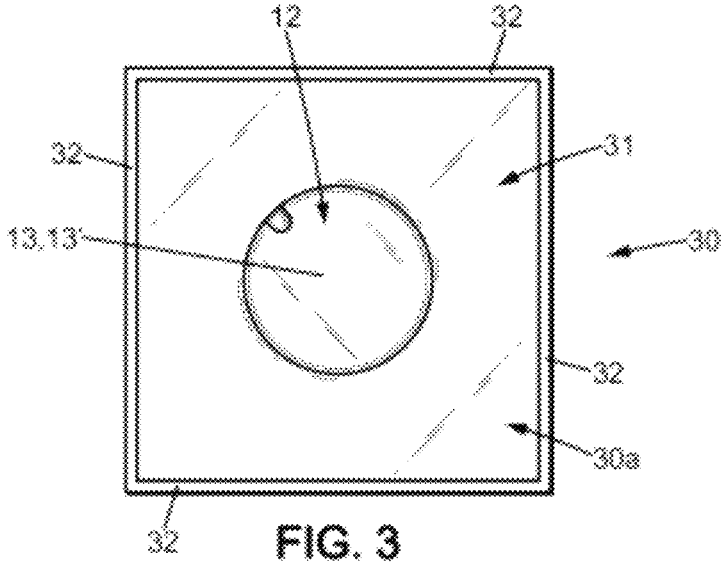
FIG. 3 schematically depicts a view of an absorption, neutralizing and signaling device according to FIG. 2, from beneath.

In the example described here and illustrated in FIGS. 3 and 4, this volume V1 opens onto an opening 12 closed by closure such as, for example, a removable cap 13 or a detachable seal 13'.

Figure 5A:
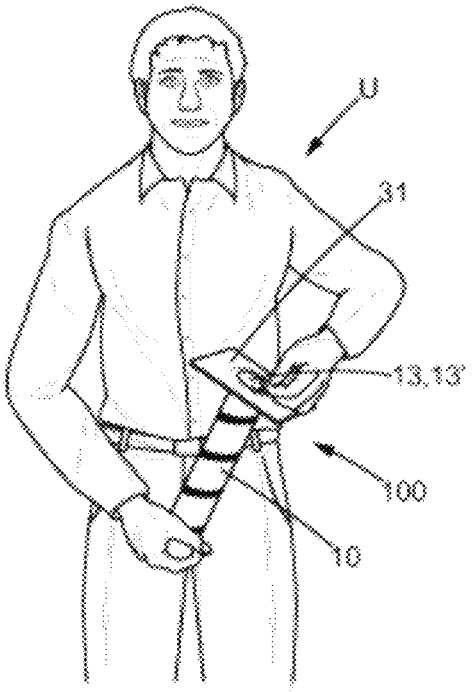
FIGS. 5*a*-5*b*-5*c*-5*d*-5*e* schematically depict the use of an absorption, neutralizing and signaling device according to FIG. 2.

From a practical standpoint, the head of department, responsible for keeping the zone safe, grasps hold of the device 100 and removes the cap 13 or detaches the seal 13' in order to open the opening 12 (see FIG. 5*a*).

In the example described here, this opening 12 opens onto the lower face 30*a* of the standing support 30.

The pouring out of the powder 20 under gravity onto the product P allows the product P to be absorbed and possibly neutralized almost immediately.

Figure 5B:
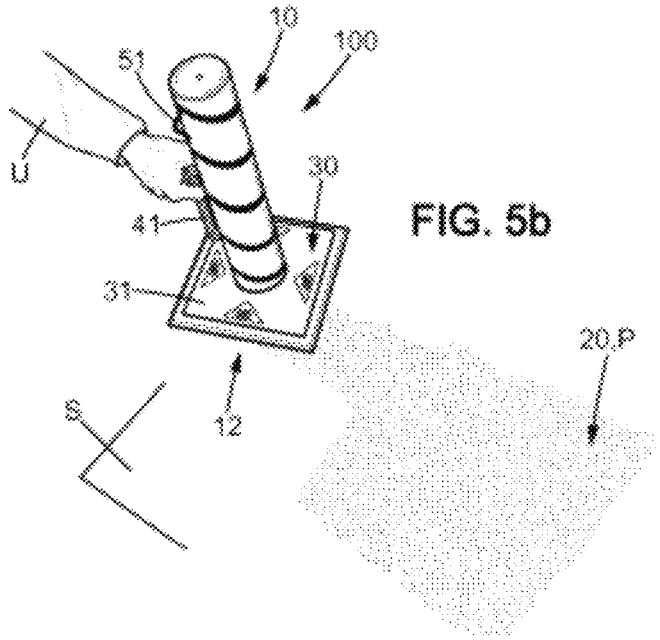

In the example described here, the head of department holds the device 100 by grip 40 such as a grab handle 41 which is formed on the exterior wall 10*b* of the cylinder (see FIG. 5*b*).

This handle 41 makes it easier to pour out the powder 20 under gravity onto the product P on the floor S.

Figure 5C:
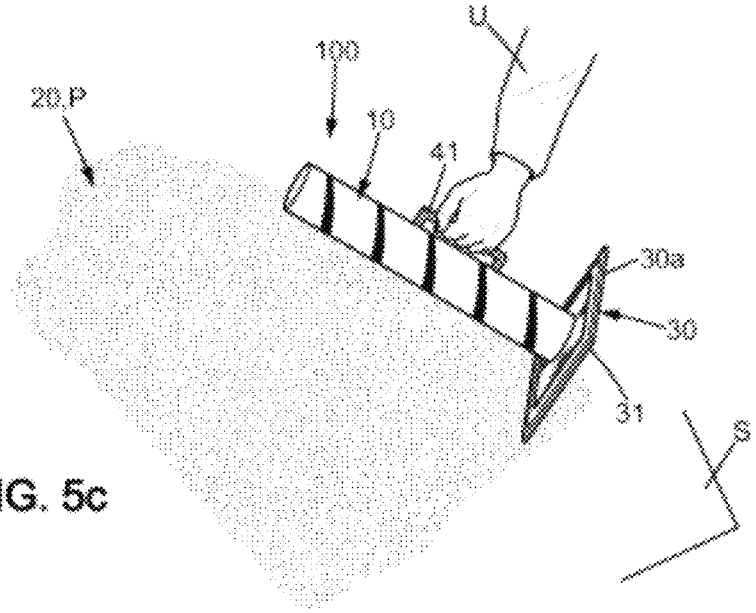

If need be, the standing support 30 of the device 100 which projects out laterally with respect to the body 10 may be used like a shovel to spread the powder 20 correctly over the paint P on the floor (see FIG. 5*c*).

Figure 5D:
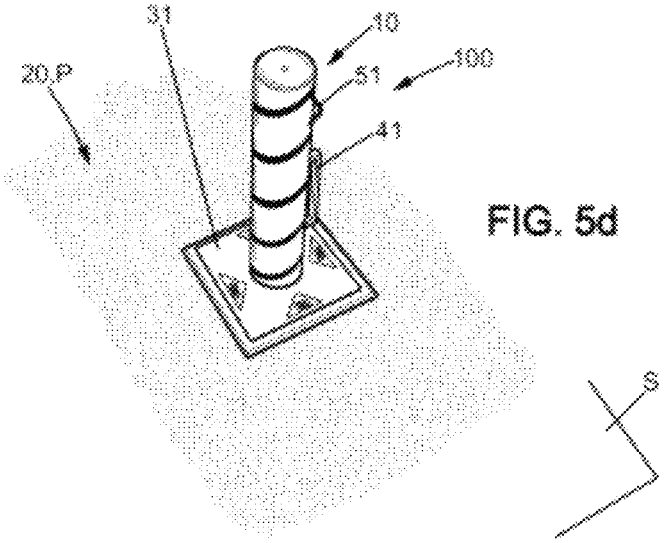
Figure 5E:
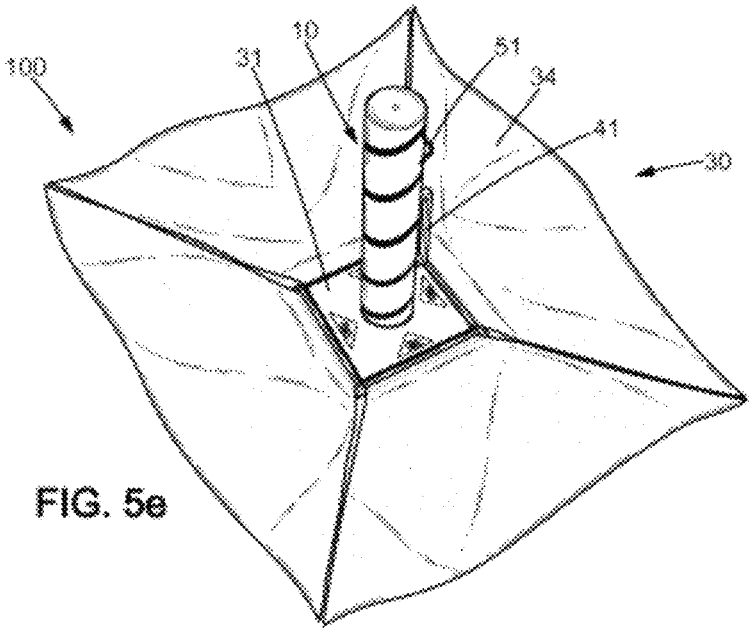

Next, all the head of department needs to do is place the standing support 10 on the paint P mixed with the powder 20 or next to it (see FIG. 5*d*).

The standing support 30 and the body 10 together form a warning cone.

All the operator needs to do is place the lower face 30*a* of the standing support 30 on the floor S.

The standing support 30 gives the cone stability on the floor S, and the hollow body 10, the exterior wall 10*b* of which may comprise suitable signaling elements, signals the presence of the (neutralized and absorbed) product P on the floor S.

In the example described here and as illustrated in FIG. 4, the standing support 30 has a wall 31 extending substantially at right angles to the longitudinal axis A of the hollow body 10, and peripheral rims 32 which extend substantially at right angles to the wall 31.

These rims 32 are used to rest the standing support 30 on the floor S.

Thus, as illustrated in FIG. 4, the peripheral rims 32 form, with the wall 31, a volume V2 which is closed when the standing support 30 is resting on the floor S.

It is thus possible to render the potentially hazardous product inaccessible and to enclose it when the product is covered with the standing support 30.

This is particularly advantageous when the surface area occupied by the product P on the floor S is smaller than the surface area occupied on the floor by the standing support 30 when the standing support 30 is placed on the floor S.

However, when the surface area occupied by the product P on the floor S is greater than the surface area occupied on the floor by the standing support 30 when the standing support 30 is placed on the floor S (as is the case in FIG. 5*d*), provision is made within the context of the present invention for the device 100 to comprise a protective film 34 which can be deployed in order to cover the entirety of the remaining area protruding beyond the standing support 30.

For preference, this film is extensible.

In the example described here, this film 34 is housed in a housing 33 formed preferably on the periphery of the upper face of the standing support.

Other alternatives to the extensible film 34 may be contemplated, such as, for example, deployment of foldable cardboard panels housed under the standing support 30 (and not depicted here).

Finally, if the product P has spilled over too large an area, it is possible to use several devices 100.

Anchor 50, such as hooks 51, are thus provided, these being formed on the exterior wall 10*b* of the body 10 of each device 100.

Figure 6:
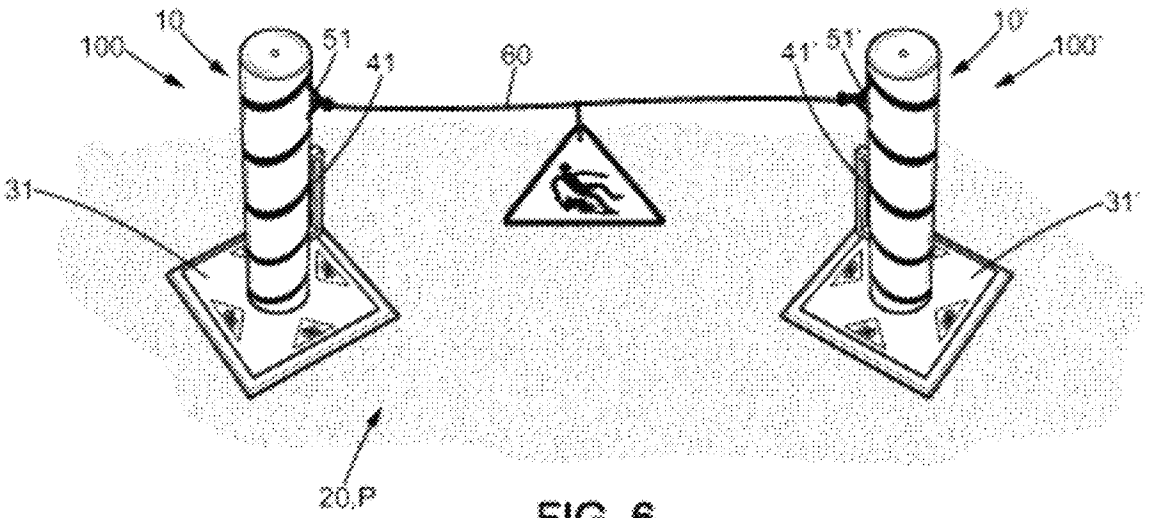
FIG. 6 schematically depicts several absorption, neutralizing and signaling devices joined together by a safety cord in order to delimit a potentially hazardous zone.

The head of department may then physically link together several devices 100 using a cord 60 so as to delimit a danger zone on the floor S (FIG. 6).

Preferably, the body 10 is made from a transparent or semitransparent material.

Alternatively, the body 10 comprises a window along the entire length of said body, this window acting as a gauge.

In either instance, it is possible for the head of department to see whether there is any powder 20 left.

Thus, the device 100 that forms the subject of the invention takes the form of an indispensable tool for ensuring safety and preventing risks in stores.

It meets both the safety and prevention standards and the requirements incumbent on those involved to ensure this safety and this prevention: it is practical, simple to use, a 2-in-1 object, takes up little space, etc.

The presence of the product P on the floor S is therefore signaled up to the end of the day.

The device can then be used to clear up the product on the floor (not depicted here).

Given the qualities of this device, it will be readily appreciated that it will find other advantageous applications such as, for example, use in an industrial context for providing safety and prevention in an industry in which the employees regularly handle hazardous products (automotive industry, chemical industry, steel making industry, etc.).

Other applications may also be contemplated such as, for example, with doctors or vets to absorb and signal liquids on the floor following, for example, discharges of urine.

It should be pointed out that this detailed description relates to one particular exemplary embodiment of the present invention but that this description does not in any way constitute any form of limitation on the subject matter of the invention; quite the contrary, its objective is to set aside any potential inaccuracy or misinterpretation of the claims which follow.

The invention claimed is:

1. A device for absorbing and indicating a potentially hazardous product on the floor, said device comprising:

a longilinear hollow body the interior walls of which define a storage volume wherein a powder, able to limit or eliminate all the potentially hazardous effects or reactions of said product when said powder comes into contact with said product, is stored, said storage volume opening onto an opening for pouring out said powder out under gravity onto said product in order to absorb said product, a standing support on which the lower end of said body is directly or indirectly mounted, said standing support projecting out laterally with respect to said body to form a warning cone so that said device can be stood stably on the floor thus indicating the presence of said product on the floor.

2. The device as claimed in claim 1, wherein said opening is closed by a removable cap.

3. The device as claimed in claim 1, wherein said opening is closed by a detachable seal.

4. The device as claimed in claim 1, wherein said opening is equipped with a pouring spout to make it easier for the powder to be poured out under gravity onto said product.

5. The device as claimed in claim 1, wherein said opening opens onto the lower face of said standing support, said lower face facing said floor when the standing support is resting on said floor.

6. The device as claimed in claim 1, wherein said standing support has:

a wall extending substantially at right angles to the longitudinal axis of said body, and peripheral rims extending substantially at right angles to said wall to serve as a support against the floor, said peripheral rims forming, with said wall, a closed volume when said standing support is resting on the floor through said rims.

7. The device as claimed in claim 1, comprising, on the periphery of said standing support, at least one housing wherein a protective film, able to be unwound to at least partially cover said product on the floor, is housed, notably when the surface area of product on the floor is greater than the surface area of said standing support.

8. The device as claimed in claim 1, wherein the standing support comprises fold-out panels housed under the standing support, said panels being able to be folded out in order to at least partially cover the product on the floor.

9. The device as claimed in any claim 1, comprising a grip formed on an exterior wall of said body to make said device easier to grasp notably when pouring said powder out under gravity onto said product.

10. The device as claimed in claim 1, comprising an anchor formed on an exterior wall of said body to attach a link so that said device can be linked with at least one other absorption and signaling device so as to delimit on the floor a zone containing a potentially hazardous product.

11. A method comprising absorbing a potentially hazardous product and indicating the presence of the potentially hazardous product on the floor using a device for absorbing and indicating a potentially hazardous product on the floor, said device comprising:

a longilinear hollow body the interior walls of which define a storage volume wherein a powder, able to limit or eliminate the potentially hazardous effects or reactions of said product when said powder comes into contact with said product, is stored, said storage volume opening onto an opening for pouring out said powder out under gravity onto said product in order to absorb said product, a standing support on which the lower end of said body is directly or indirectly mounted, said standing support projecting out laterally with respect to said body to form a warning cone so that said device can be stood stably on the floor thus indicating the presence of said product on the floor.

12. The method as claimed in claim 11 wherein the device is used in a store.

13. The method of claim 11 wherein the device is used in an industrial environment.

14. The device as claimed in claim 2, wherein said opening is equipped with a pouring spout to make it easier for the powder to be poured out under gravity onto said product.

15. The device as claimed in claim 3, wherein said opening is equipped with a pouring spout to make it easier for the powder to be poured out under gravity onto said product.

16. The device as claimed in claim 2, wherein said opening opens onto the lower face of said standing support, said lower face facing said floor when the standing support is resting on said floor.

17. The device as claimed in claim 3, wherein said opening opens onto the lower face of said standing support, said lower face facing said floor when the standing support is resting on said floor.

18. The device as claimed in claim 2, wherein said standing support has:

a wall extending substantially at right angles to the longitudinal axis of said body, and peripheral rims extending substantially at right angles to said wall to serve as a support against the floor, said peripheral rims forming, with said wall, a closed volume when said standing support is resting on the floor through said rims.

19. The device as claimed in claim 3, wherein said standing support has:

a wall extending substantially at right angles to the longitudinal axis of said body, and peripheral rims extending substantially at right angles to said wall to serve as a support against the floor, said peripheral rims forming, with said wall, a closed volume when said standing support is resting on the floor through said rims.

* * * * *